US010166807B2

(12) United States Patent
Mueller

(10) Patent No.: US 10,166,807 B2
(45) Date of Patent: Jan. 1, 2019

(54) METHOD AND DEVICE FOR APPLYING PORTIONS OF A BACKLINING MATERIAL TO THE BACK OF A BOOK BLOCK

(71) Applicant: Mueller Martini Holding AG, Hergiswil (CH)

(72) Inventor: Hans Mueller, Lauda-Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 179 days.

(21) Appl. No.: 14/972,391

(22) Filed: Dec. 17, 2015

(65) Prior Publication Data

US 2016/0176217 A1 Jun. 23, 2016

(30) Foreign Application Priority Data

Dec. 19, 2014 (CH) ..... 2001/14

(51) Int. Cl.
*B42C 9/02* (2006.01)
*B42C 9/00* (2006.01)

(52) U.S. Cl.
CPC ..... *B42C 9/02* (2013.01); *B42C 9/0056* (2013.01); *B42C 9/0062* (2013.01); *B42C 9/0068* (2013.01); *B42C 9/0075* (2013.01)

(58) Field of Classification Search
CPC ... B42C 9/0056; B42C 9/0062; B42C 9/0068; B42C 9/0072; B42C 9/02
USPC ..... 412/26, 27, 30, 31
See application file for complete search history.

(56) References Cited

U.S. PATENT DOCUMENTS 1,874,165 A * 8/1932 Bredenberg ..... B42C 9/02 412/31
3,420,723 A * 1/1969 Thorp ..... B42C 9/02 412/31
4,898,506 A * 2/1990 Lazar ..... B42C 7/00 412/8

(Continued)

FOREIGN PATENT DOCUMENTS

DE 102013004497 * 9/2014 ..... B42C 9/02
DE 102013004497 A1 9/2014
EP 1894739 B1 3/2008

(Continued)

OTHER PUBLICATIONS

DE 102013004497 A1 Translation.*

*Primary Examiner* — Kyle R Grabowski
(74) *Attorney, Agent, or Firm* — Leydig, Voit & Mayer, Ltd.

(57) ABSTRACT

A method for applying portions of a backlining material to a back of a book block includes transporting the book block in a conveying direction in a book production line. The back of the book block is provided with an adhesive, wherein the book block is initially provided with the adhesive over an entire back length of the book block in a single application process. Then, the portions of the backlining material are applied in succession to the back of the book block, wherein at least a first portion of the backlining material is applied by a first conveying device and subsequently at least a second portion of the backlining material is applied by a second conveying device to the back of the book block such that at least one of the portions overlaps another one of the portions.

13 Claims, 10 Drawing Sheets

(56) References Cited

U.S. PATENT DOCUMENTS

| | | | | |
|---|---|---|---|---|
| 2008/0056849 | A1* | 3/2008 | Muller | B42C 9/02 412/30 |
| 2010/0310339 | A1* | 12/2010 | Mueller | B42C 19/08 412/19 |

FOREIGN PATENT DOCUMENTS

| | | | | | |
|---|---|---|---|---|---|
| EP | 2269836 | A2 | | 1/2011 | |
| EP | 2347914 | A2 | * | 7/2011 | B42C 9/02 |
| FR | 1270824 | A | * | 9/1961 | B42C 9/02 |
| GB | 385193 | A | * | 12/1932 | B42C 9/02 |

* cited by examiner

METHOD AND DEVICE FOR APPLYING PORTIONS OF A BACKLINING MATERIAL TO THE BACK OF A BOOK BLOCK

CROSS-REFERENCE TO PRIOR APPLICATION

Priority is claimed to Swiss Patent Application No. CH 02001/14, filed on Dec. 19, 2014, the entire disclosure of which is hereby incorporated by reference herein.

FIELD

The present invention relates to a method for applying portions of a backlining material to the back of a book block. The book block is transported in a conveying direction in a book production line and the back of the book block is provided with an adhesive. The portions of the backlining material are applied in succession to the back, provided with the adhesive, of the book block, by at least one conveying device.

The present invention further relates to a device for applying portions of a backlining material to the back of the book block, comprising a conveying device for transporting the book block through a book production line in a conveying direction, a pasting apparatus for applying the adhesive to the back of the book block, at least one backlining station comprising at least one supply apparatus for the backlining material, and at least one cutting apparatus for cutting the portions of the backlining material to length in accordance with a thickness of the back of the relevant book block, and comprising at least one conveying device configured to apply the portions of the backlining material to the back, provided with adhesive, of the book block.

The present invention further relates to a book production line.

BACKGROUND

Backlining, in which a generally strip-shaped reinforcing material consisting of raised woven fabric, gauze or tear-proof paper (kraft paper or crêpe paper) is applied to the back of the book block to reinforce the back and thus provide dimensional stability of the subsequent book throughout the reading life thereof, is an essential step in the manufacture of books from book blocks. Additional reinforcement of the back can be achieved by previously applying gauze, which takes on a hinge function between the book back and the cover in a region projecting beyond the back on both longitudinal sides, together with the end sheets which are also applied there. During the manufacture of hardcover books, a headband, in other words a coloured band, is also applied to the upper and lower edge of the book block during backlining, and neatly covers the transition from the book block to the cover.

DE102013004497 A1 discloses a method and a corresponding device for mechanically backlining and headbanding a series of book blocks having different back lengths. In this method, two portions of a backlining material are applied in succession to the back of a book block so as to overlap with each other, the back initially being pasted and the two portions being applied to the back of the book block in succession in separate backlining stations and finally being pressed on. Initially, there is a first adhesive application to the part of the back to which the first portion of the backlining material is to be applied. After this first portion is applied to the part of the back provided with adhesive, the remaining part of the back and an overlap region of the portion of the backlining material already applied to the back are provided with adhesive, before the second portion of the backlining material is applied to the back of the book block and applied to the first portion of the backlining material in the overlap region. As a result of this staggered application of the adhesive and the immediate covering of the region provided with adhesive with the corresponding portion of the backlining material, soiling of the device can be prevented and largely fault-free operation of the device can thus be ensured. In addition, in each case a headband may be glued to the web of the backlining material before the corresponding portions are separated off from this web and applied to the back, provided with adhesive, of the book block. DE102013004497 A1 does not discuss the configuration of a supply apparatus of the backlining material to the two backlining stations and in particular the configuration of conveying means for applying the portions of the backlining material to the back of the book block.

EP2269836 A2 discloses a method and a device for mechanically backlining or headbanding the backs of book blocks in a book production line equipped with a single backlining station. In this case, at least two portions of backlining material, specifically a portion of the backlining material covering the entire back of the book block and a gauze strip which projects beyond said portion at the longitudinal sides, are interconnected to form a joint backlining complex which is applied to the pasted book block back as a whole and pressed on. The device comprises at least two supply apparatuses for providing different backlining materials to a conveying means provided with suction elements, the suction elements being moved between the respective handover points of the supply apparatuses to the conveying means and the back of the book block.

For rapidly adapting the backlining complex to different back lengths of book blocks to be backlined in succession, these supply apparatuses may be mutually offset in such a way that the portions of the backlining material in the backlining complex overlap in such a way that the resulting backlining complex corresponds to the back length of the relevant book block. A drawback of this is the poor accessibility of the points of the backlining station where the offset of the supply apparatuses with respect to one another is to take place. In addition, the storage apparatuses for the different backlining materials have to be applied in positions which can be mutually offset, and this makes ergonomic loading thereof impossible. Furthermore, access to the respective pasting apparatuses and the paste application nozzles thereof is heavily restricted by the spatial relationships, and disposing of the side cuttings of the backlining material is made difficult. A further drawback is the relatively large number of adhesion points at which the individual backlining materials have to be connected to form the backlining complex. At each adhesion point, and in particular when the gauze strip is glued on, there is the possibility of soiling of the device, and this can lead to disruption of the operation of the book production line.

EP1894739 B1 also discloses a device for backlining and headbanding the backs of book blocks in a book production line. In this case, the backlining material is transported by a single supply apparatus to the book production line, where it is cut to length, in other words tailored to the thickness of the back of the relevant book block, and applied to the back of the relevant book block by a suction element of a conveying means. For this purpose, the suction element is initially pivoted into a receiving position, in which it sucks up a portion of the backlining material accordingly cut to length in advance, and transports this portion through a pivot movement into a release position to the back of the book block.

SUMMARY

In an embodiment, the present invention provides a method for applying portions of a backlining material to a back of a book block. The book block is transported in a conveying direction in a book production line. The back of the book block is provided with an adhesive, wherein the book block is initially provided with the adhesive over an entire back length of the book block in a single application process. Then, the portions of the backlining material are applied in succession to the back of the book block, wherein at least a first portion of the backlining material is applied by a first conveying device and subsequently at least a second portion of the backlining material is applied by a second conveying device to the back of the book block such that at least one of the portions overlaps another one of the portions.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
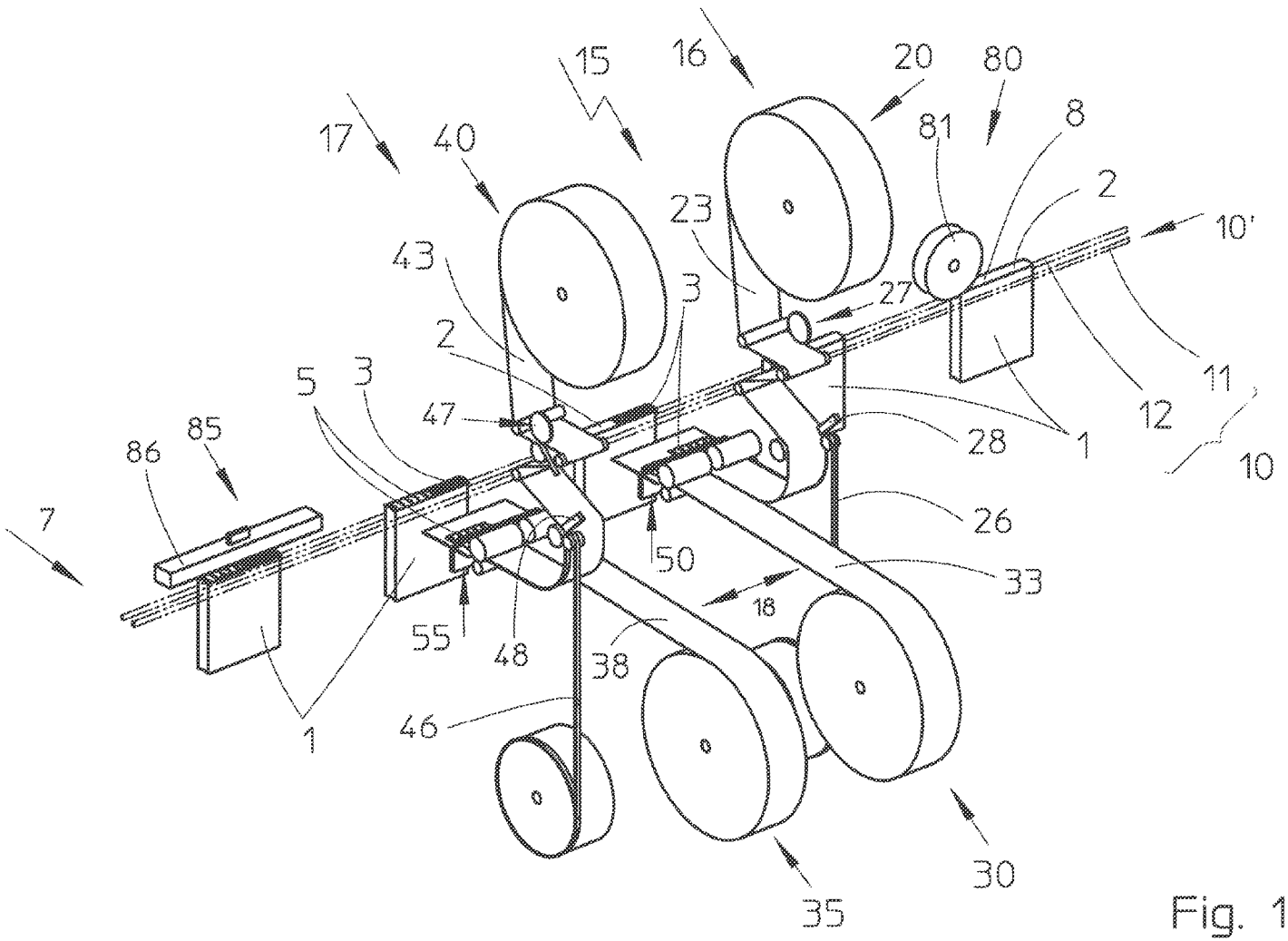
FIG. 1 is a perspective drawing of a book production line in the region of a tandem backlining station.

In an embodiment, the present invention provides a flexible method which meets the various requirements on manufacturing books having different sizes and/or contents in succession and a corresponding device for backlining over the entire range of sizes of a book production line. The device provides a compact, cost-effective construction, whilst having good accessibility and being comfortable to operate, whilst the method ensures fault-free operation without the requirement of manual interventions in the event of size change.

According to an embodiment of the invention, a book block is transported in a conveying direction in a book production line and the back thereof is provided with an adhesive. Subsequently, portions of a backlining material are applied in succession to the back, provided with the adhesive, of the book block, by at least one conveying device. Furthermore, the back of the book block is initially provided with the adhesive over the entire back length thereof in a single application process. Then, in the subsequent application of the portions, a first portion or a first portion and at least one further portion of the backlining material are applied by a first conveying device and subsequently at least a second portion or a second portion and at least one further portion of the backlining material are applied by a second conveying device, so as to overlap with each other, to the back, provided with the adhesive, of the book block.

As a result of this continuous paste application over the entire back length, by contrast with the prior art, a second pasting process and a complete pasting apparatus can be omitted, and a more efficient method sequence and a compact, cost-effective construction can thus be achieved. The overlapping application of the portions of the backlining material makes it possible to cover a larger range of sizes and thus to have a more flexible method than with portions applied to one another. The use of two separate conveying devices for applying the portions advantageously makes it possible to ensure good accessibility to the supply apparatuses.

In an advantageous embodiment of the method, the portions of the backlining material are positioned on the back of the book block by the conveying devices in such a way that the at least two overlapping portions completely cover the back of the book block.

In a further embodiment of the method, the first conveying device applies a first portion of the backlining material and the second conveying device applies a second portion of the backlining material to the back, provided with the adhesive, of the book block. In addition, at least one further portion of the backlining material is applied by the first conveying device, jointly with the first portion and overlapping the first portion, and/or a further portion of the backlining material is applied by the second conveying device, jointly with the second portion and overlapping the second portion, to the back of the book block, between the first and the second portion. In this context, each portion of the backlining material subsequently to be applied to the back of the book block is applied so as to overlap with a portion already previously applied to the back of the book block. The portions respectively applied to the back of the book block cover it completely over the back length thereof.

By contrast with the use of merely two portions of the backlining material, the size range to be covered can be greatly increased by applying at least one further portion of the backlining material. In addition, this further portion may advantageously be applied selectively by the first and/or by the second conveying device. Finally, depending on the configuration of the backlining stations and the conveying devices, it is also possible to provide a further portion or even a plurality of further portions for each conveying devices.

In a further embodiment of the method, the conveying devices each comprise at least one suction element comprising a first segment and comprising at least one second segment, the first segment of the first conveying device applying the first portion of the backlining material and the first segment of the second conveying device applying the second portion of the backlining material to the back of the book block, whilst the second segment, of which there is at least one in each case, of the suction elements does not apply a further portion of the backlining material to the back of the book block. In each case, the at least one second segment is provided offset or becomes offset with respect to the first segment in such a way that a contact face of the first segment touches the back of the book block, whilst a contact face of the second segment is at a distance from the back of the book block. "Touching" means that relevant contact face touches the back of the book block via the portion of the backlining material held thereby, whilst "at a distance" means that relevant contact face does not come into contact with the adhesive applied to the back of the book block.

As a result of the positioning of the contact face of the second segment at a distance from the back of the book block, the region of the back of the book block which is pasted but not covered with a portion of the backlining material still cannot be soiled with adhesive, ensuring fault-free operation of the device.

In a further embodiment of the method, the backlining material for the first portion and the backlining material for the at least one further portion are supplied to the first conveying device in an overlapping manner and/or the backlining material for the second portion and the backlining material for the at least one further portion are supplied to the second conveying device in an overlapping manner.

By this method, the portions of the backlining material can be applied to the back of the book block in an overlapping and simple manner.

In a further embodiment of the method, during or after the application of portions of a backlining material to the back of a first book block in the book production line, portions of a backlining material are also applied to the back of a further book block, the back of the further book block having a different back length from the back of the first book block and the conveying devices being mutually offset in or counter to the conveying direction in such a way that, after the steps of pasting the entire back and applying a first portion or a first portion and at least one further portion and subsequently applying at least a second portion or a second portion and at least one further portion of the backlining material are completed, the first portion of the backlining material and the second portion of the backlining material or the first portion and at least one further portion of the backlining material and the second portion and at least one further portion of the backlining material completely cover the back of the further book block in an overlapping manner in each case.

In this way, advantageously, book blocks having different sizes can be produced in direct succession without manual intervention.

According to an embodiment of the invention, a conventional device for applying portions of a backlining material to the back of a book block, comprising a conveying apparatus for transporting the book block through a book production line in a conveying direction, a pasting apparatus for applying an adhesive to the back of the book block, at least one backlining station comprising at least one supply apparatus for the backlining material and at least one cutting apparatus for cutting the portions of the backlining material to length in accordance with a thickness of the back of the relevant book block, and comprising at least one conveying device configured to apply the portions of the backlining material to the back, provided with adhesive, of the book block, comprises, arranged in succession in the conveying direction, a single pasting apparatus for applying the adhesive to the back of the book block and over the entire back length thereof, a first conveying device for applying a first portion or a first portion and at least one further portion of the backlining material and at least one second conveying device for applying, so as to overlap with the first portion or with the first portion and the at least one further portion, at least one second portion or a second portion and at least one further portion of the backlining material to the back, provided with adhesive, of the book block.

Since the device merely comprises a single pasting apparatus for applying the adhesive to the entire back of the book block, by contrast with the prior art, a complete pasting apparatus can be omitted and a compact, cost-effective construction can thus be achieved. The arrangement of at least two separate conveying devices makes it possible to apply the portions of the backlining material to the back of the book block in an overlapping manner, meaning that this device can advantageously process a larger range of sizes of book blocks. In addition, the use of at least two separate conveying devices makes it possible to ensure improved accessibility to the supply apparatuses.

In one embodiment of the device, the conveying devices each comprise a suction element having a first and having at least a second segment for receiving, temporarily holding and releasing a portion of the backlining material each. In this context, the relevant portion is held during the transport thereof from the backlining station to the back of the book block.

Using suction elements of this type, equipped with at least two segments, the portions of the backlining material can each be applied to the back of the book block individually, in such a way that each backlining station can selectively process one or more portions.

In a further embodiment of the device, the first segment comprises a first face for contacting the back of the book block and the at least one second segment comprises a second face for contacting the back of the book block, the at least one second segment being formed so as to be offsettable with respect to the first segment in such a way that the contact face of the first segment touches the back of the book block whilst a contact face of the second segment is at a distance from the back of the book block.

As a result of the positioning of the contact face of the second segment at a distance from the back of the book block, the region of the back of the book block which is pasted but not covered with a portion of the backlining material still cannot be soiled with adhesive, ensuring fault-free operation of the device.

In a further embodiment of the device, in each case an actuator for offsetting the at least one second segment with respect to the first segment is arranged on the suction element.

The actuators are a binding member of the device comprising a machine control system which controls the tandem backlining station as a function of the size of the book block to be processed in each case. At least by means of the actuators, the machine control system controls the supply apparatuses in use, the position of the offsettable segments, and also active hole systems for applying air/vacuum. In configurations of this type, the backlining station is thus fully automatable. Production is thus possible without a system operator having to intervene manually.

In a further embodiment of the device, equipped with the above-disclosed conveying devices, the suction element is arranged on the relevant conveying device so as to be replaceable with another suction element different from said suction element.

In this way, the suction element can advantageously be adapted to a different width of the web of the backlining material.

In a further embodiment of the device comprising the above-disclosed conveying devices, at least one first and/or second segment is arranged on the relevant suction element so as to be replaceable with another segment different from said first and/or second segment.

Thus, analogously to the above-disclosed advantage, the first and/or the at least one second segment can advantageously be adapted to a different width of the web of the backlining material.

In a further embodiment of the device, at least two supply apparatuses for the backlining material are arranged upstream from the first conveying device and/or upstream from the second conveying device and mutually offset in the conveying direction in such a way that the backlining material for the first portion and the backlining material for the at least one further portion can be supplied to the first conveying device in an overlapping manner and/or the backlining material for the second portion and the backlining material for the at least one further portion can be supplied to the second conveying device in an overlapping manner.

This configuration of the device makes it possible to apply the portions of the backlining material to the back of the book block in an overlapping and simple manner.

In a further embodiment of the device, at least two backlining stations, arranged in succession in the conveying direction of the book block through the book production line, form a joint tandem backlining station comprising at least one supply apparatus in each case for providing the portions of the backlining material.

Using two backlining stations arranged in this manner, the portions of the backlining material can be applied to the back of the relevant book block in an overlapping manner, and book blocks having different back lengths can thus be processed. In addition, this arrangement of the backlining stations makes it possible to ensure good accessibility to the supply apparatuses.

In a further embodiment of the device the conveying devices are each assigned two supply apparatuses for the backlining material, the second supply apparatus in each case being switchable by a machine control system in accordance with the size of the book block to be provided with portions of a backlining material.

The machine control system can automatically set the device to produce books having different sizes and/or contents in succession; in other words, changes can be made from one book block to the next.

A book production line equipped with a device according to any of the above-disclosed embodiments is particularly advantageous. A book production line of this type makes industrial book production possible.

The above-disclosed suction elements can be used in the methods according to the invention and can be retrofitted into existing devices for applying portions of a backlining material to the back of a book block in a book production line. The suction elements make it possible to automatically apply portions of a backlining material which are adapted to the size of the book block currently to be processed to the back of the relevant book block.

Figure 1A:
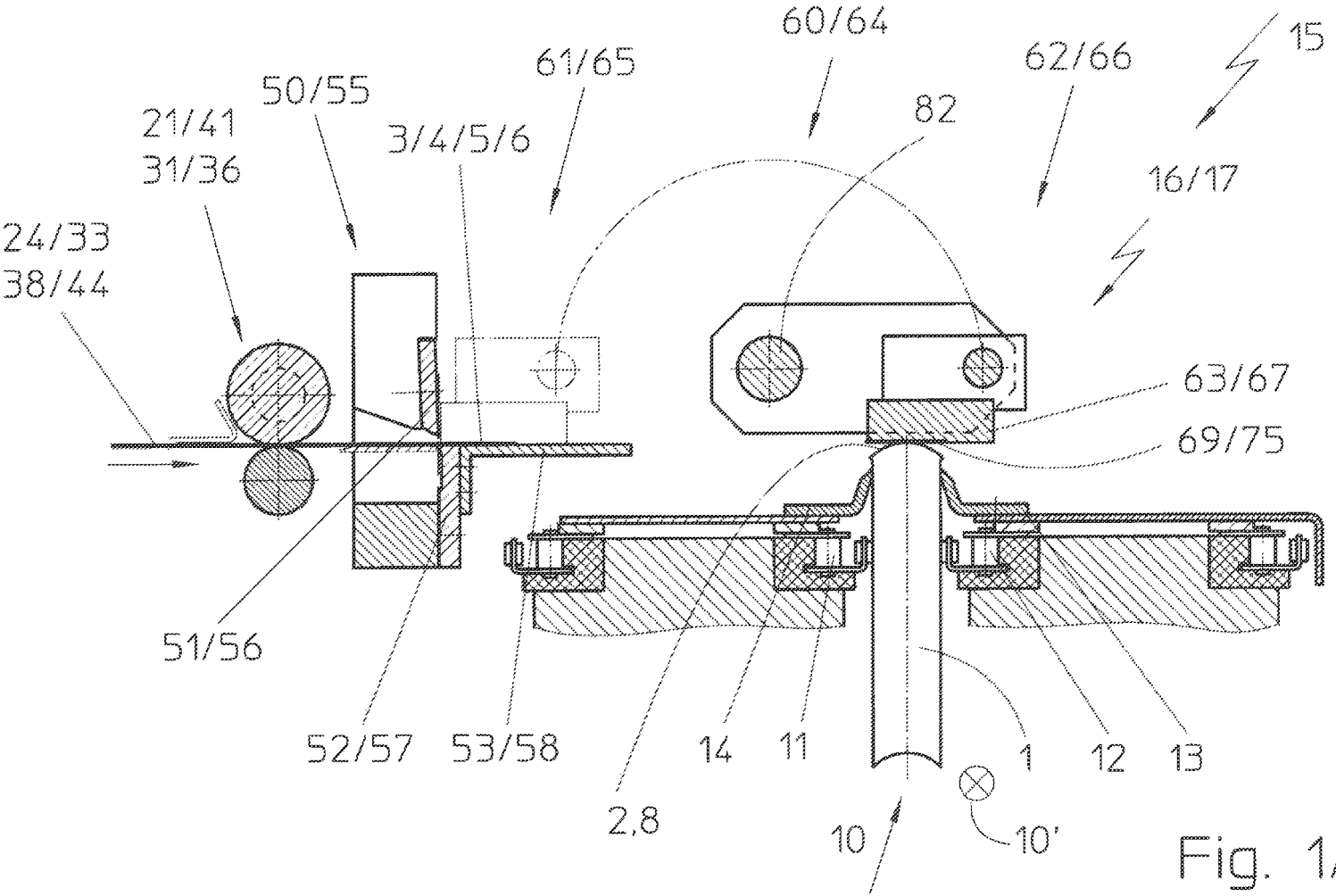
FIG. 1A is a section of a conveying apparatus for book blocks and a right and left backlining station each comprising a conveying device for portions of a backlining material web, each comprising a withdrawal apparatus and a cutting apparatus.

FIG. 1 shows a tandem backlining station 15 in a book production line 7, substantially comprising a pasting apparatus 80 which provides the back 2 of a book block 1 with an adhesive 8 over the entire back length 9 (FIG. 6) thereof, an upstream (right) and a downstream (left) backlining station 16, 17 each having a first supply apparatus 20, 40 for web-shaped backlining material 23, 43 and each having a second supply apparatus 30, 35 for further web-shaped backlining material 33, 38, a side cutting apparatus 27, 47 for cutting the sides, a pasting nozzle 28, 48 for applying a headband 26, 46 to the backlining material 23, 43, a cutting apparatus 50, 55 formed as a transverse cutter for cutting the backlining material 23, 33, 38, 43 to length, in other words for separating off portions 3, 4, 5, 6 (FIG. 5) corresponding to a thickness 19 (FIG. 2) of the relevant back 2 of the book block 1, conveying devices 60, 64, shown in FIG. 1A, for applying the portions 3, 4, 5, 6 to the pasted back 2 of the book block 1, a pressing apparatus 85 which presses these portions 3, 4, 5, 6 on and which comprises a pressing element 86, and a conveying apparatus 10 which clamps the book block 1 at an equal distance between two transport chains 11, 12 and transports it intermittently through the book production line 7 in a conveying direction 10' corresponding to the longitudinal direction of the back 2 of the book block 1.

In the pasting apparatus 80, the upward-facing back 2 of the book block 1 is provided with the adhesive 8 over the entire back length 9 (FIG. 6) thereof using an application roller 81 adaptable to the back shape. In general, subsequently, in the upstream (right) backlining station 16, the conveying device 60 applies a first portion 3 or a first portion 3 and at least one further portion 4 of the backlining material 23, 33 and subsequently, in the downstream (left) backlining station 17, the conveying device 64 applies at least a second portion 5 or a second portion 5 and at least one further portion 6 of the backlining material 43, 38 to the back 2, provided with the adhesive 8, of the book block 1, in an overlapping manner and covering said back completely. In this context, a headband 26, 46 may additionally be applied to the backlining material 23, 43 for the first and/or the second portion 3, 5. Accordingly, for cutting the first portion 3 to length in the right backlining station 16, either the backlining material 23 or a backlining material web 24 formed from the backlining material 23 and the headband 26 is available. Correspondingly, for cutting the second portion 5 to length in the left backlining station 17, either the backlining material 43 or a backlining material web 44 formed from the backlining material 43 and the headband 46 is made available.

The at least one further portion 4 of the backlining material 33 used in addition to the first and second portion 3, 5, depending on the size of the book block 1 to be processed, is applied to the back 2 of the pasted book block 1 together with the first portion 3 by the first conveying device 60, so as to overlap the first portion 3. After the subsequent overlapping application of the second portion 5, the at least one further portion 4 is applied to the pasted back 2 of the book block 1 between the first and the second portion 3, 5 in such a way that it overlaps both the first and the second portion 3, 5.

Analogously, depending on the size of the book block 1 to be processed, in addition to the first and second portion 3, 5 and either in addition to or as an alternative to the at least one further portion 4 of the backlining material 33, the at least one further portion 6 of the backlining material 38 is applied to the back 2 of the pasted book block 1 together with the second portion 5 by the second conveying device 64, so as to overlap the second portion 5. The at least one further portion 6 is subsequently applied to the pasted back 2 of the book block 1 between the first and second portion 3, 5 in such a way that it overlaps both the first and the second portion 3, 5. If, in addition to this at least one further portion 6 of the backlining material 38, at least one further portion 4 of the backlining material 33 has also previously been applied together with the first portion 3, the two further portions 4, 6 applied to the back of the book block overlap with each other.

As a matter of basic principle, any portion 5, 6 of the backlining material 43, 38 subsequently to be applied to the back 2 of the book block 1 is applied so as to overlap a portion 3, 4 previously applied to the back 2 of the book block 1.

The overlap of the portions 3, 4 to be applied jointly to the back 2 of the book block 1 or of the portions 5, 6 to be applied jointly to the back 2 of the book block 1 can be provided in that the supply apparatuses 20, 30 for the backlining material 23, 33, which are arranged upstream from the first conveying device 60, and the supply apparatuses 40, 35 for the backlining material 43, 38, which are arranged upstream from the second conveying device 64, are mutually offset in the conveying direction 10' in such a way that the backlining material 23 for the first portion 3 and the backlining material 33 for the at least one further portion 4 are supplied to the first conveying device 60 in an overlapping manner and/or the backlining material 43 for the second portion 5 and the backlining material 38 for the at least one further portion 6 are supplied to the second conveying device 64 in an overlapping manner.

Naturally, the first portion 3 and the at least one further portion 4 as well as the second portion 5 and the at least one further portion 6 may also be applied to the back 2 of the book block 1 individually by the relevant conveying device 60, 64 in respectively successive work steps. In a method of this type, the overlap of the first portion 3 and the at least one further portion 4 and the overlap of the second portion 5 and the at least one further portion 6 can be provided by way of the intermittent operation of the conveying apparatus 10. A mutually offset arrangement of the respective supply apparatuses 20, 30, 35, 40 is not required in this case.

Figure 2:
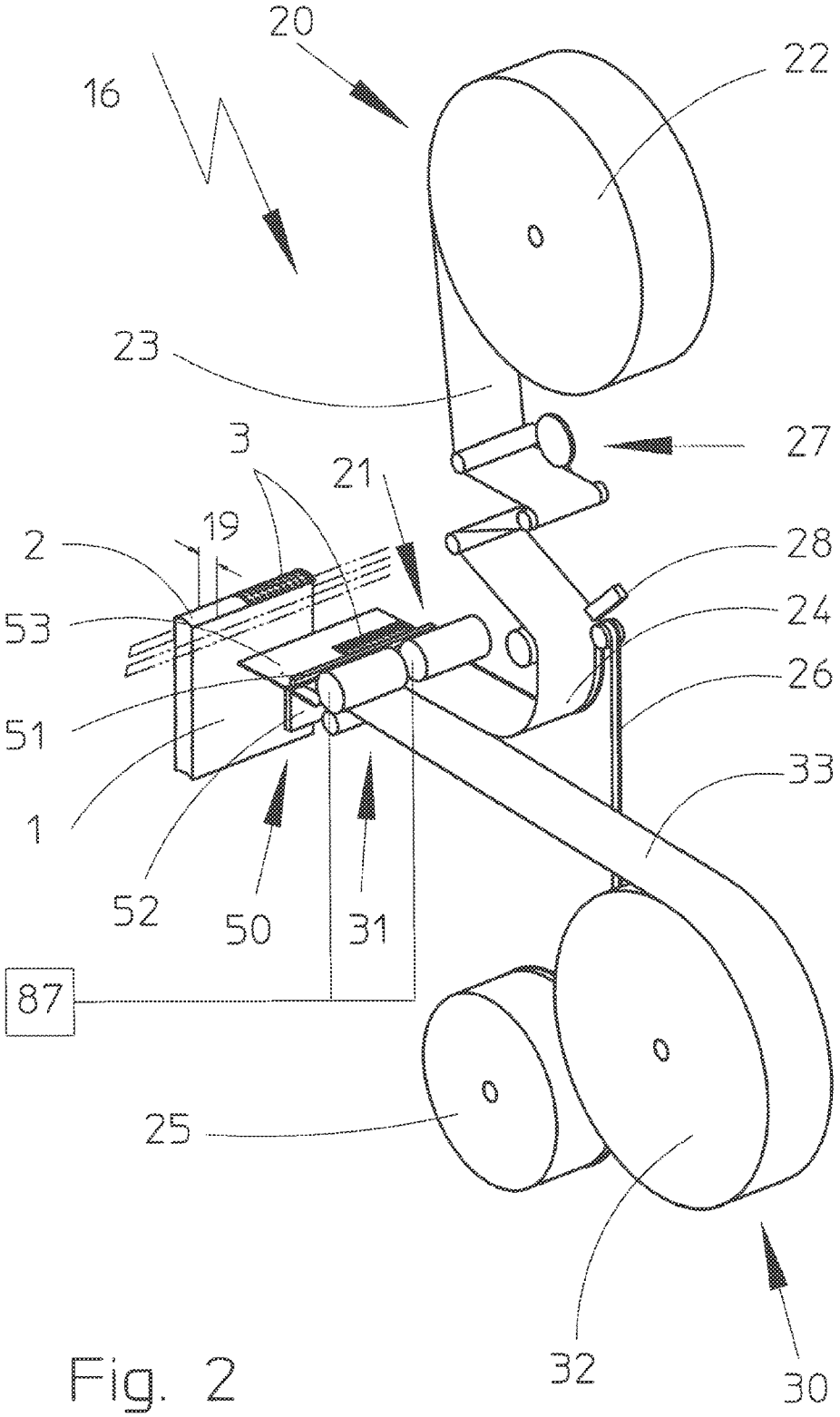
FIG. 2 is a perspective view of the right backlining station.

As is shown in detail in FIG. 2, in the first supply apparatus 20 of the right backlining station 16 web-shaped backlining material 23 is withdrawn from a storage apparatus 22 in the form of a roller, cut on the right side by the side cutting apparatus 27, pasted on the right edge by the pasting nozzle 28, and glued to the headband 26 unwound from a headband roller 25 to form a backlining material web 24. This is slid, by a withdrawal apparatus 21, under an upper blade 51 of the cutting apparatus 50 in the form of a transverse cutter, where it is cut to length in accordance with the back 2 of the respective book block 1, in other words tailored to the thickness 19 of this back 2. For this purpose, a machine control system 87 of the relevant withdrawal apparatus 21, 31 specifies a corresponding cutting measurement on the basis of the book block data. The resulting first portion 3 of the backlining material web 24 is initially positioned on a support table 53 adjacent to a lower blade 52 of the cutting apparatus 50. Naturally, it is also possible merely to use a backlining material 23 without an additional headband 26, instead of the backlining material web 24 formed from the backlining material 23 and the headband 26.

Figure 5:
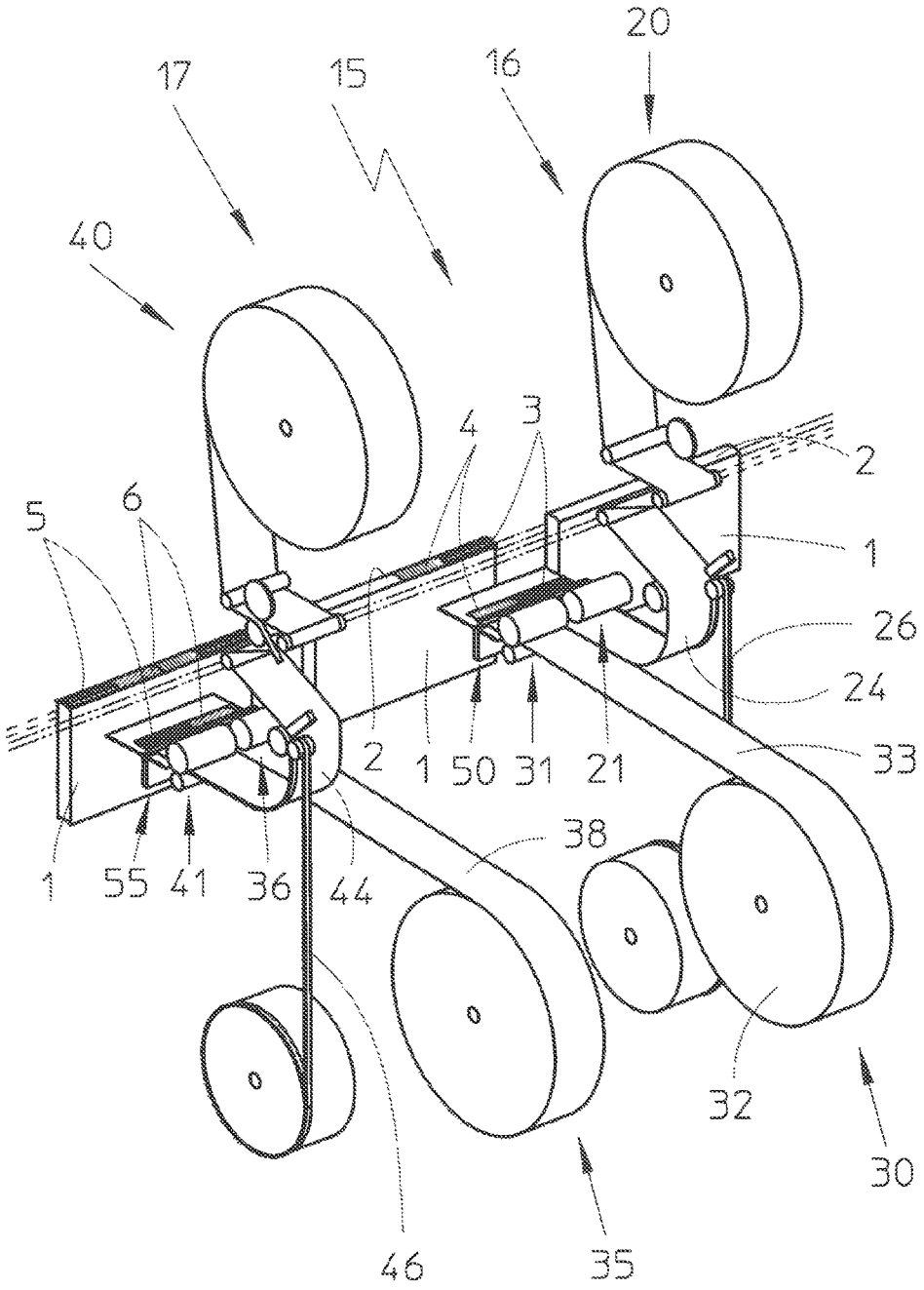
FIG. 5 is a perspective view of the tandem backlining station comprising four portions of the backlining material which are to be applied to the back of the book block.

In the second supply apparatus 30 of the right backlining station 16, when required, the further web-shaped backlining material 33 is withdrawn from a storage apparatus 32 by a withdrawal apparatus 31 and advanced under the upper blade 51, located in the upper position, of the cutting apparatus 50 in accordance with the thickness 19 of the back 2 of the book block 1. The advanced backlining material 33 is also cut to length accordingly and the further portion 4 of the backlining material 33 is thus produced, and is initially positioned on the support table 53 adjacent to the lower blade 52 of the cutting apparatus 50 (FIG. 5). When the second supply apparatus 30 is in an idle position, the backlining material 33 coming from the storage apparatus 32 is clamped by the withdrawal apparatus 31 and ends, as shown in FIG. 2, directly upstream from the lower blade 52 of the cutting apparatus 50.

Figure 2A:
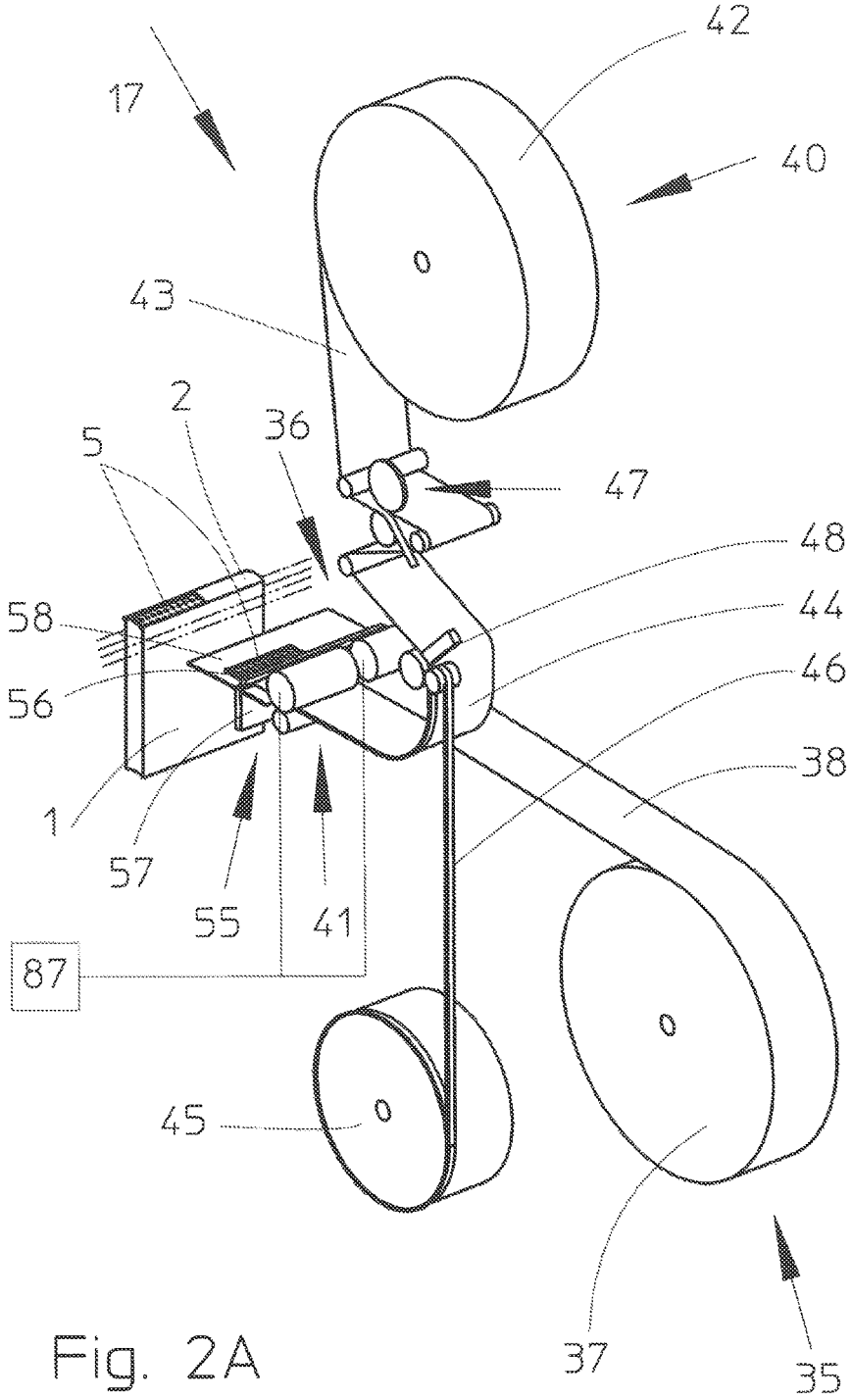
FIG. 2A is a perspective view of the left backlining station.

As is shown in detail in FIG. 2A, in the first supply apparatus 40 of the left backlining station 17 the backlining material 43 withdrawn from a storage apparatus 42 in the form of a roller is cut on the left side by a side cutting apparatus 47, pasted on the left edge by the pasting nozzle 48, and glued to the headband 46 unwound from a headband roller 45 to form a backlining material web 44. This is slid, by a withdrawal apparatus 41, under an upper blade 56 of the cutting apparatus 55, where it is cut to length in accordance with the back 2 of the relevant book block 1, in other words tailored to the thickness 19 of the back 2. The second portion 5, cut off from the backlining material web 44 in this manner, of the backlining material web 44 is now positioned on the support table 58 adjacent to a lower blade 57 of the cutting apparatus 55. Naturally, it is also possible merely to use a backlining material 43 without an additional headband 46, instead of the backlining material web 44 formed from the backlining material 43 and the headband 46.

In the second supply apparatus 35 of the left backlining station 17, when required, the further web-shaped backlining material 38 is withdrawn from a storage apparatus 37 likewise in the form of a roller by a withdrawal apparatus 36 and advanced under the cutting apparatus 55. The advanced backlining material 38 is subsequently also cut to length accordingly and the further portion 6 of the backlining material 38 is thus produced, and is initially positioned on a support table 58 adjacent to the lower blade 57 of the cutting apparatus 55 (FIG. 5). When the second supply apparatus 35 of the left backlining station 17 is in an idle position, the backlining material 38 coming from the storage apparatus 37 is clamped by the withdrawal apparatus 36 and ends, as shown in FIG. 2A, directly upstream from the lower blade 57 of the cutting apparatus 55.

As is shown in FIG. 1A, a 180° pivot movement of a suction element 63, 67, orientated parallel to the relevant support table 53, 58, of the conveying devices 60, 64 of the backlining stations 16, 17, arranged in succession in the conveying direction 10', of the tandem backlining station 15 brings about a receiving position 61, 65 or a release position 62, 66 for the relevant portion 3, 4, 5, 6 of the backlining material web 24, 44 or of the backlining material 33, 38. Before the cutting apparatus 50, 55 cuts off a portion 3, 4, 5, 6 from the backlining material web 24, 44, consisting of the backlining material 23, 43 and the headband 26, 46 glued thereto, or from the backlining material 33, 38, by lowering the upper blade 51, 56 thereof onto the relevant lower blade 52, 57, the suction element 63, 67 of the conveying devices 60, 64 is pivoted into the receiving position 61, 65, so as ultimately to clamp the first or second portion 3, 5 and if required in each case at least one of the further portions 4, 6 between the relevant suction element 63, 67 and the support table 53, 58. After the subsequent cutting to length, the suction element 63, 67 sucks up the first or second portion 3, 5 or the first portion 3 and the at least one further portion 4 or the second portion 5 and the at least one further portion 6 and transports these in each case through a 180° pivot movement into the release position 62, 66. Depending on the spatial arrangement of the receiving position 61, 65 with respect to the release position 62, 66, it is naturally also possible to select a different pivot angle for this pivot movement. The pivot movement may also take place in the same horizontal plane as the supply of the relevant portion 3, 5 or the respective portions 3, 4, 5, 6 to the support table 53, 58.

The book blocks 1 are transported to the relevant backlining station 16, 17 of the tandem backlining station 15 in succession, in a standing arrangement with the backs 2 facing upwards, by the two mutually opposing, intermittently circulating transport chains 11, 12 of the conveying apparatus 10, and are orientated and supported by lateral guides 13, 14 in the process. During this transport, the backs 2 of the book blocks 1 to be processed are each provided with the adhesive 8 over the entire back length 9 thereof in a single application process in the pasting apparatus 80.

In the release position 62 of the conveying device 60 of the right backlining station 16, the suction element 63 applies a first portion 3 or a first portion 3 and at least one further portion 4 of the backlining material 23, 33, depending on what was previously provided at the support table 53, to the back 2, provided with adhesive 8, of the associated book block 1. Subsequently, the suction element 67 in the release position 66 of the conveying device 64 of the left backlining station 17 applies at least a second portion 5 or a second portion 5 and at least one further portion 6 of the backlining material 43, 38 to the back 2, provided with adhesive 8, of the same book block 1. After the respective portions 3, 4, 5, 6 are applied, the two suction elements 63, 67 pivot back into the respective receiving positions 61, 65 thereof, so as to take up the next portion 3, 5 or the next portions 3, 4, 5, 6 in the same way for a subsequent book block 1 of the same size. In the pressing apparatus 85 (FIG. 1), downstream from the tandem backlining station 15 and comprising a pressing element 86, the portions 3, 4, 5, 6 of the backlining material web 24, 44 or of the backlining material 33, 38 which are applied to the pasted back 2 of the book block 1 are pressed onto the back 2 uniformly and over the entire area. In this context, the pressing element 86 is for example in the form of a pressing pad, in other words a flexible pad made of foam or similar materials.

Figure 6:
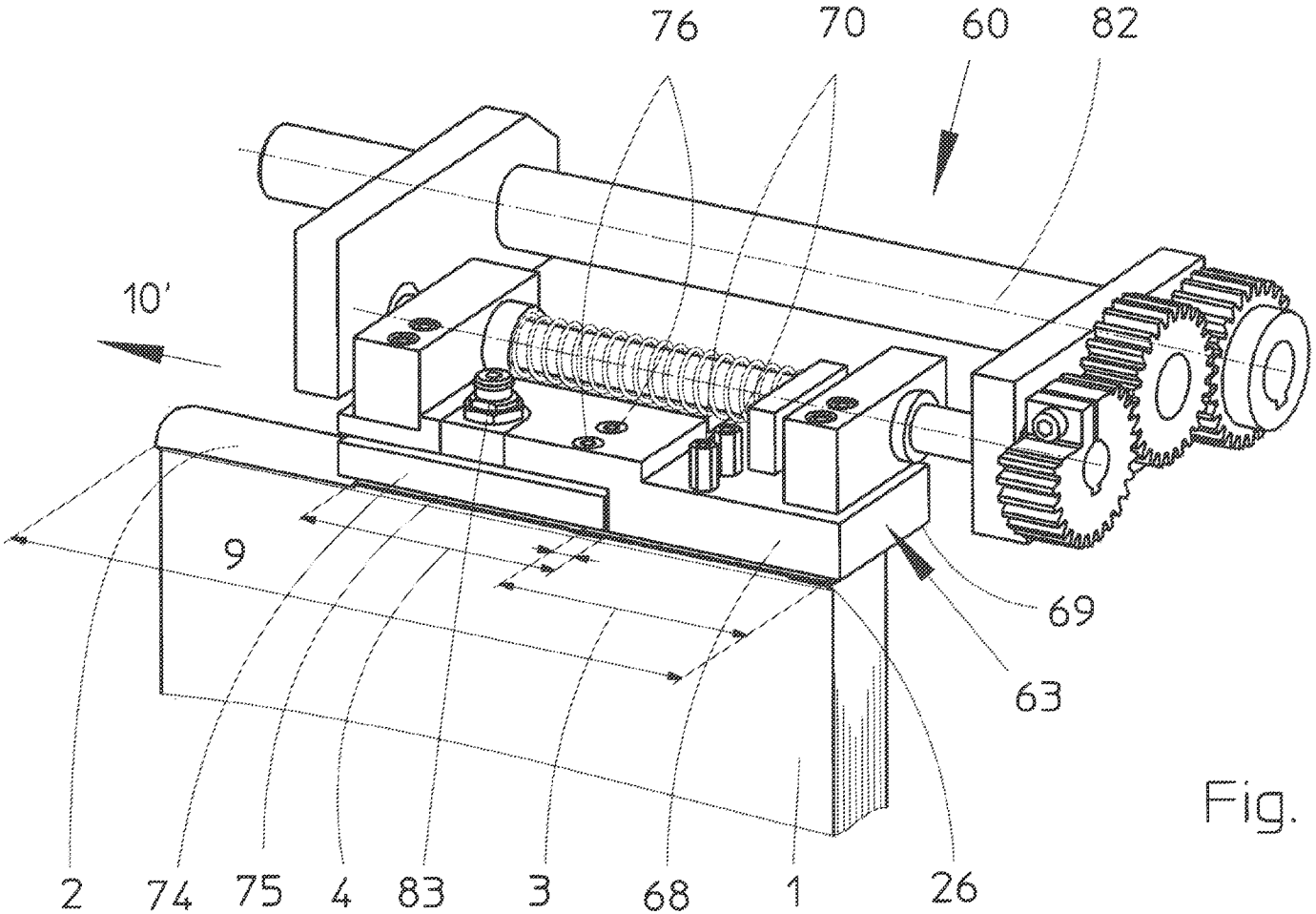
FIG. 6 is a perspective view of the conveying device of the right backlining station, which was not shown in detail in FIG. 2 for reasons of clarity, a suction element applying two portions of the backlining material to the book block in an overlapping manner.

One way the conveying devices 60, 64 of the tandem backlining station 15 differ from the conveying devices of a conventional backlining station is that the suction element 63, 67 is of a segmented construction in each case, in other words is subdivided into individual segments 68, 74, shown in FIG. 6, 7, 8, each comprising a face 69, 75 for contacting the back 2 of the book block 1. The length of these segments 68, 74 in the conveying direction 10' of the book blocks 1 depends on the relevant storage apparatus 22, 32, 37, 42 or on the width of the backlining material 23, 33, 38, 43 located in the storage apparatus 22, 32, 37, 42.

Figure 7:
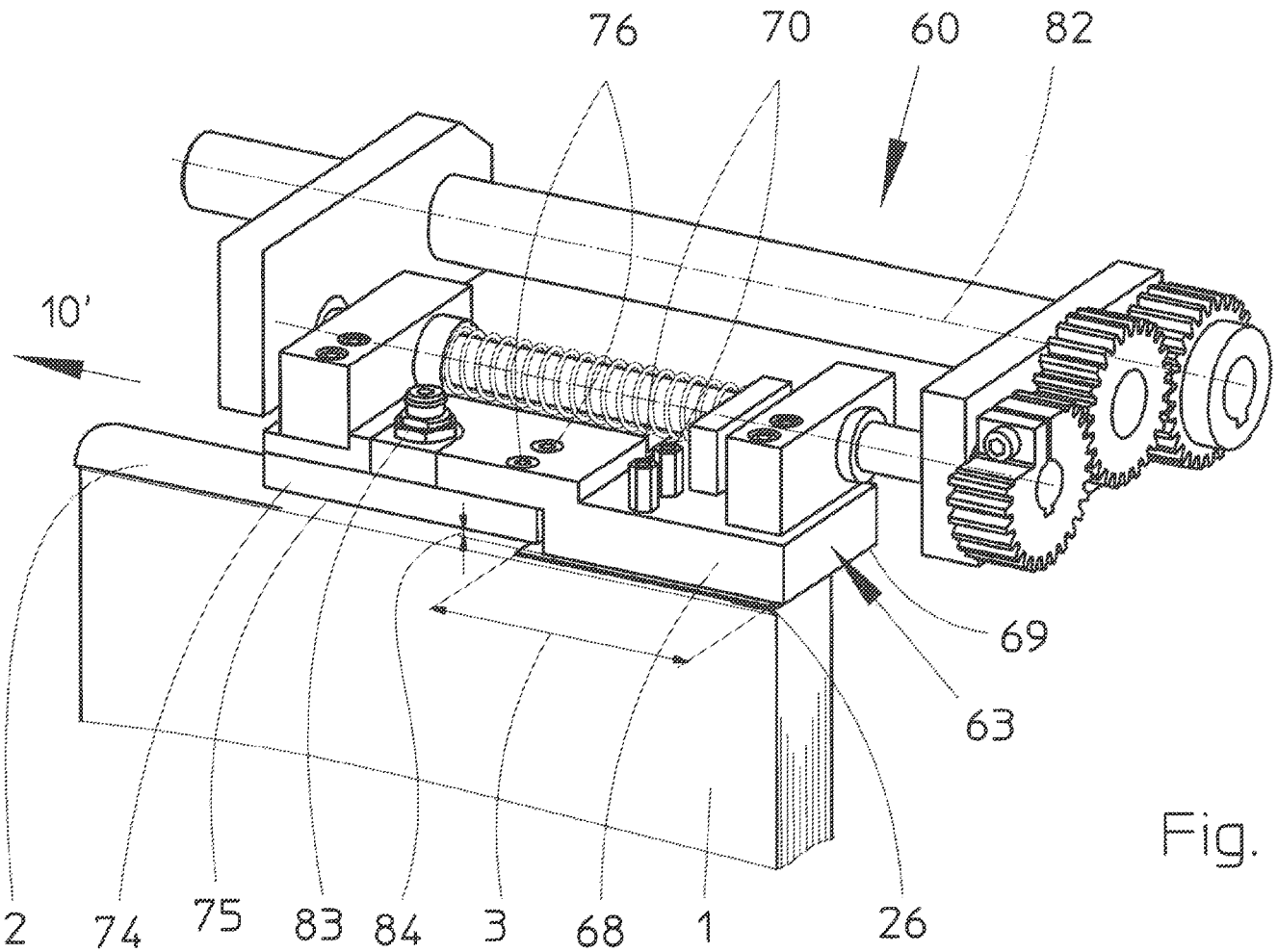
FIG. 7 is a perspective view of the conveying device shown in FIG. 6, the suction element merely applying a single portion of the backlining material to the book block.

If, for example, the second segment 74, shown in FIG. 7, of the suction element 63 is not occupied by a further portion 4 of the backlining material 33, this segment 74 is offset, with respect to the first segment 68, occupied by the first portion 3 of the backlining material web 24, of the suction element 63, in such a way that the contact face 75 thereof is not in contact with the back 2 of the book block 1, whilst the contact face 69, occupied by the first portion 3 of the backlining material web 24, is in contact with the back 2 of the book block 1 or with the first portion 3 applied thereto. In this context, the actual height difference between the contact faces 69, 75 is not decisive. Rather, what is essential is that the contact face 75, which is not occupied by a further portion 4 of the backlining material 33, of the second segment 74 does not pick up any adhesive 8 from the back 2 of the book block 1, since soiling of this type would inevitably lead to faults in the book production line 7.

Figure 3:
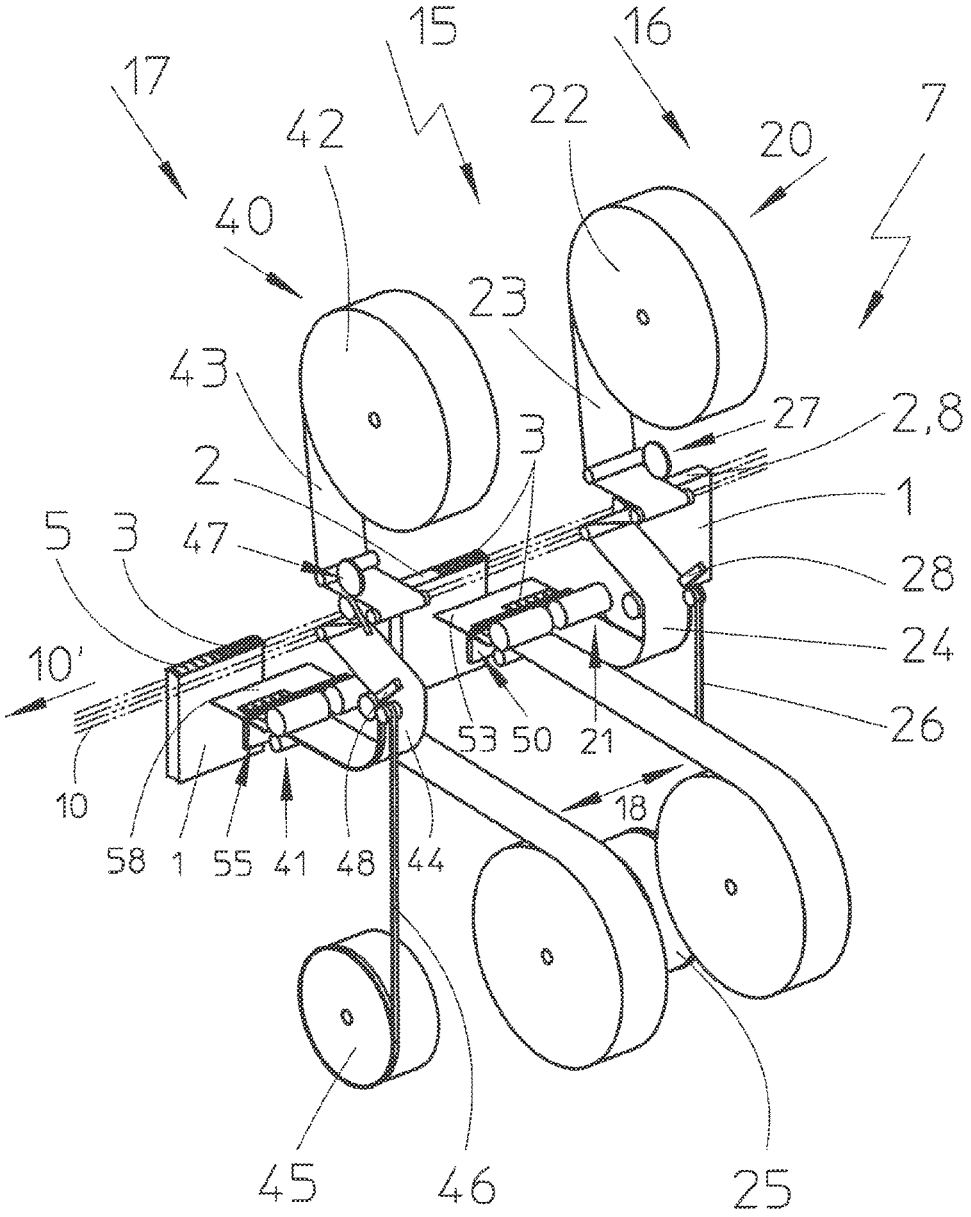
FIG. 3 is a perspective view of the tandem backlining station comprising two portions of a backlining material which are to be applied to the back of a book block.
Figure 4:
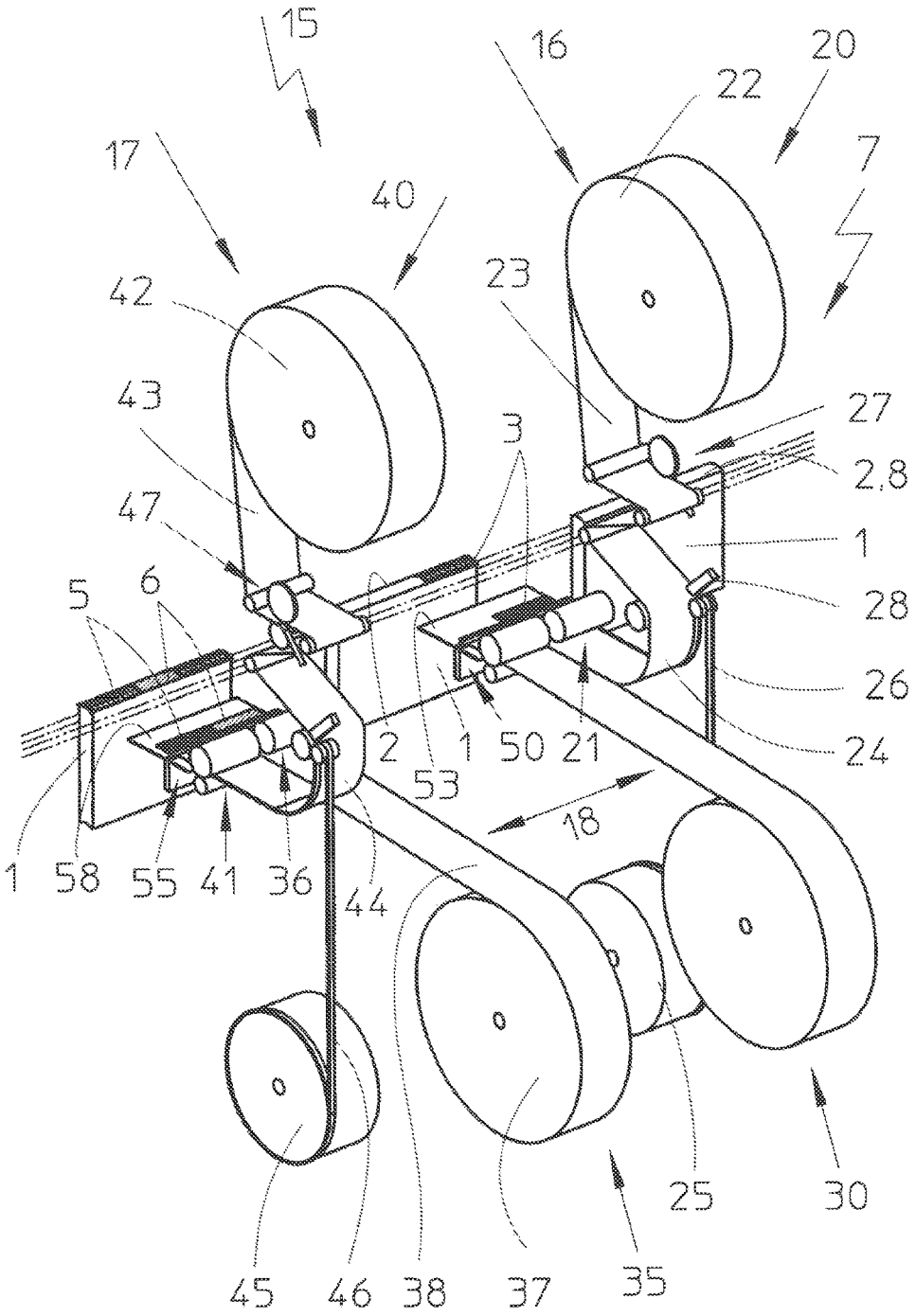
FIG. 4 is a perspective view of the tandem backlining station comprising three portions of the backlining material which are to be applied to the back of the book block.

If the size of the book block 1 to be backlined is changed, the machine control system 87 (FIG. 2, 2A) causes the two backlining stations 16, 17 to be adjusted in opposite directions, by way of an adjustment apparatus 18 merely indicated by a double-headed arrow in FIGS. 1, 3 and 4, until the respective portions 3, 4, 5, 6 of the backlining material web 24, 44 or of the backlining material 33, 38 can be applied in a precise fit to the back 2 of the new book block 1 which differs from the size of the previously processed book block 1.

In the following, a plurality of different method sequences are disclosed, which are each dependent on the size of the book block 1 to be processed.

FIG. 3 shows a tandem backlining station 15, in which book blocks 1 are processed which have a size in which the first portion 3 of the backlining material web 24 is applied in the right backlining station 16 and the second portion 5 of the backlining material web 44 is applied in the left backlining station 16 to the back 2 of a book block 1. For this purpose, by means of the withdrawal apparatuses 21, 41, initially a backlining material 23, 43 is in each case withdrawn from the two storage apparatuses 22, 42 of the first supply apparatuses 20, 40, cut by means of the side cutting apparatus 27, 47 in each case, and in each case connected to a headband 26, 46 to form a backlining material web 24, 44, which is subsequently slid under the cutting apparatus 50, 55, where it is cut to length in accordance with the thickness 19 (FIG. 2) of the back 2 of the relevant book block 1. The resulting first and second portion 3, 5 of the backlining material web 24, 44 is initially positioned on the support table 53, 58 downstream from the relevant cutting apparatus 50, 55, and is subsequently applied to the back 2 of the book block 1 by means of the conveying devices 60, 64 (FIG. 1A).

FIG. 4 shows a tandem backlining station 15 in which book blocks 1 are processed which have a size in which a first and a second portion 3, 5 of the backlining material web 24, 44 and a further portion 6 of the backlining material 38 are respectively applied to the back 2 of the book block 1. For this purpose, in addition to the sequence previously disclosed in relation to FIG. 3, the withdrawal apparatus 36 of the left backlining station 17 withdraws a backlining material 38 from the storage apparatus 37 of the second supply apparatus 35, slides it under the cutting apparatus 55 alongside the backlining material web 44, and cuts it to length in accordance with the thickness 19 (FIG. 2) of the back 2 of the associated book block 1. The resulting further portion 6 of the backlining material 38 is now positioned together with the second portion 5 of the backlining material web 44 on the support table 58 adjacent to the lower blade 57 of the cutting apparatus 55, and is applied to the back 2 of the book block 1 by the conveying device 64 (FIG. 1A) of the left backlining station 17.

FIG. 5 shows a tandem backlining station 15, in which book blocks 1 are processed which have a size in which a first and a second portion 3, 5 of the backlining material webs 24, 44 and in each case a further portion 4, 6 of the backlining material 33, 38 are respectively applied to the back 2 of the book block 1. For this purpose, in addition to the sequence previously disclosed in relation to FIG. 4, the withdrawal apparatus 31 of the right backlining station 16 withdraws a backlining material 33 from the storage apparatus 32 of the second supply apparatus 30, slides it under the cutting apparatus 50 alongside the backlining material web 24, and cuts it to length in accordance with the thickness 19 (FIG. 2) of the back 2 of the associated book block 1. The resulting further portion 4 of the backlining material 33 is now positioned together with the first portion 3 of the backlining material web 24 on the support table 53 adjacent to the lower blade 52 of the cutting apparatus 50, and is applied to the back 2 of the book block 1 by the conveying device 60 (FIG. 1A) of the right backlining station 16.

The conveying device 60, shown in greater detail in FIG. 6, of the right backlining station 16 has the suction element 63, divided into the two segments 68, 74, in the release position 62 (FIG. 1A) for the first and the further backlining portion 3, 4. The first portion 3, comprising the backlining material 23 and the headband 26 glued thereto, is received by the first segment 68 of the suction element 63. The second segment 74 of the suction element 63 is in the working position thereof, and has received the further portion 4 of the backlining material 33. The two portions 3 and 4 overlap slightly in the central region.

Figure 8:
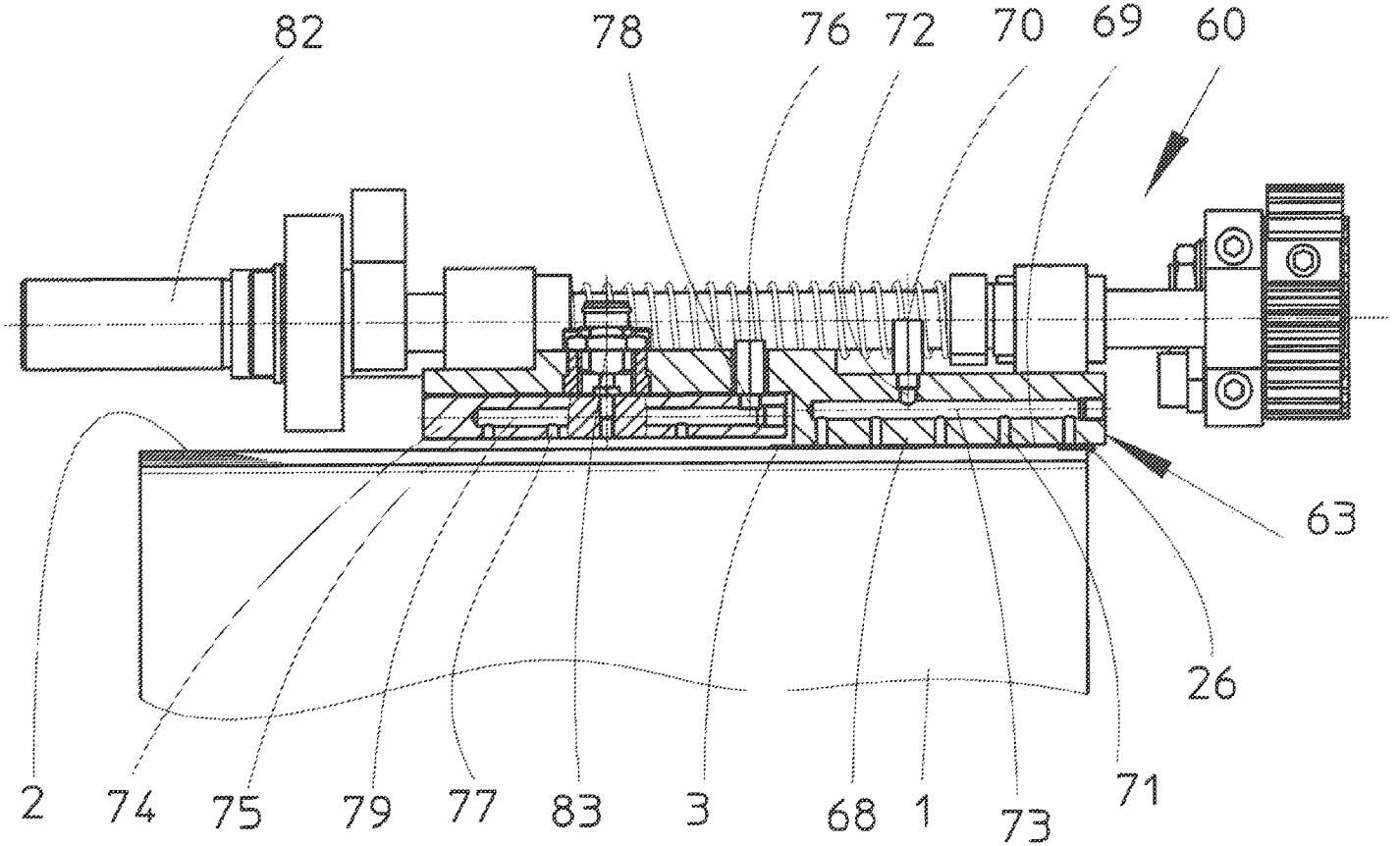
FIG. 8 is a section, taken parallel to the conveying direction of the book block, through the conveying device shown in FIG. 7.

The two segments 68, 74 of the conveying device 60 of the right backlining station 16 each have a hole system 70, 76, shown in greater detail in FIG. 8, comprising first suction holes 71, 77 which penetrate through the relevant contact face 69, 75, each comprising at least a second hole 72, 78, penetrating for example upwards through the segments 68, 74, and in each case a third hole 73, 79, connecting the respective first suction holes 71, 77 and the at least one second hole 72, 78 in each case. The hole system 70, 76 sucks up the portions 3, 4 shown in FIG. 6 by means of suction air in the receiving position 61, and releases these portions 3, 4 by blowing off or releasing them, in the release position 62, to the back 2, provided with the adhesive 8, of the book block 1 (FIG. 1A). In this context, the suction air is sucked through the second hole 72, 78, of which there is at least one in each case.

A rotational movement, brought about by a pivot shaft 82, moves the suction element 63 back and forth between the receiving position 61 and the release position 62. By means of an actuator 83, for example in the form of a pneumatic cylinder, the second segment 74 of the suction element 63 of the right conveying device 60 can selectively be positioned in a work position located on the back 2 of the book block 1 or in a retracted idle position.

FIG. 7 shows the state in which the conveying device 60 of the right backlining station 16 merely has to apply the first portion 3 of the backlining material web 24. For this purpose, the second segment 74 is offset into the idle position thereof by means of the actuator 83, in such a way that it is held back by one segment length 84 with respect to the first segment 68. This provides that the second segment 74 does not come into contact with adhesive 8 of the pasted back 2 of the book block 1. The part of the back 2 of the book block 1 which has not been provided with one or more portions 3, 4 by the conveying device 60 is subsequently backlined with at least one portion 5, 6 supplied by the conveying device 64 of the left backlining station 17.

As is shown in FIG. 8, the segments 68 and 74 of the suction element 63 are each provided with at least one mutually independently operating hole system 70, 76, through which the suction air is withdrawn via the second hole 72, 78 of which there is at least one in each case, or through which blown air can be introduced. Depending on the width of the portions 3, 4 of the backlining material web 24 or the backlining material 33, it is also possible to use a plurality of hole systems 70, 76, as is shown in FIG. 7 using two hole systems 70, 76 by way of example. The hole systems 70, 76 can be switched on or off individually by the machine control system 87.

The conveying device 64 of the left backlining station 17 is constructed analogously to, but substantially as a mirror image of, the above-disclosed conveying device 60 of the right backlining station 16, and operates in an analogous manner. As an alternative to an analogous construction to the conveying device 60, the conveying device 64 of the left backlining station 17 may also merely comprise a single segment or else more than two segments.

The machine control system 87 controls the supply apparatuses 20, 30, 35, 40 which are in use, the position of the offsettable second segments 74, and also the active hole systems 70, 76 for applying air/vacuum.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A device for applying portions of a backlining material to backs of book blocks, the device comprising:

a conveying apparatus configured to transport the book blocks through a book production line in a conveying direction;

a single pasting apparatus configured to apply an adhesive over an entire back length of the backs of the book blocks;

at least one backlining station comprising at least one supply apparatus configured to supply the backlining material and at least one cutting apparatus configured to cut the portions of the backlining material to length in accordance with a thickness of the back of a respective one of the book blocks to be supplied with the backlining material;

a first conveying device disposed after the single pasting apparatus in the conveying direction and configured to apply at least a first portion of the backlining material; and at least one second conveying device disposed after the first conveying device in the conveying direction and configured to apply at least a second portion to the backs of the book blocks such that, in each case, at least one of the portions overlaps another one of the portions, wherein the single pasting apparatus is the only pasting apparatus of the device.

2. The device according to claim 1, wherein the conveying devices each comprise a suction element having a first segment and at least one second segment, each of the suction elements being configured to receive, temporarily hold and release a respective one of the portions of the backlining material.

3. The device according to claim 2, wherein each of the first segments comprise a first face configured to contact the backs of the book blocks and each of the at least one second segments comprises a second face configured to contact the backs of the book blocks, each of the at least one second segments being formed so as to be offsettable with respect to a respective one of the first segments in such a way that the contact face of the first segment touches the back of the book block whilst a contact face of the at least one second segment is at a distance from the back of the book block.

4. The device according to claim 2, wherein, in each case, an actuator configured to offset the at least one second segment with respect to the first segment is arranged on the suction element.

5. The device according to claim 2, wherein each of the suction elements is arranged on a respective one of the conveying devices so as to be replaceable with another, different suction element.

6. The device according to claim 2, wherein at least one of the first segment and the at least one second segment is arranged on relevant respective one of the suction elements so as to be replaceable with another, different segment.

7. The device according to claim 1, wherein at least two of the supply apparatuses for the backlining material are arranged upstream from the first conveying device and/or upstream from the second conveying device and are offset from one another in the conveying direction in such a way that the backlining material for the first portion and the backlining material for at least one third portion are supplyable to the first conveying device in an overlapping manner and/or the backlining material for the second portion and the backlining material for at least one fourth portion are supplyable to the second conveying device in an overlapping manner.

8. The device according to claim 1, wherein at least two of the backlining stations are arranged in succession in the conveying direction of the book blocks through the book production line so as to form a joint tandem backlining station comprising at least one of the supply apparatuses in each case configured to provide the portions of the backlining material.

9. The device according to claim 1, wherein each of the conveying devices is assigned a first supply apparatus and a second supply apparatus for the backlining material, the second supply apparatus in each case being switchable by a machine control system in accordance with a respective size of a respective one of the book blocks to be provided with the portions of the backlining material.

10. A book production line comprising a device according to claim 1.

11. A device for applying portions of a backlining material to backs of book blocks, the device comprising:

a conveying apparatus configured to transport the book blocks through a book production line in a conveying direction;

a single pasting apparatus configured to apply an adhesive over an entire back length of the backs of the book blocks;

at least one backlining station comprising at least one supply apparatus configured to supply the backlining material and at least one cutting apparatus configured to cut the portions of the backlining material to length in accordance with a thickness of the back of a respective one of the book blocks to be supplied with the backlining material;

a first conveying device disposed after the single pasting apparatus in the conveying direction and configured to apply at least a first portion of the backlining material; and at least one second conveying device disposed after the first conveying device in the conveying direction and configured to apply at least a second portion to the backs of the book blocks such that, in each case, at least one of the portions overlaps another one of the portions, wherein the conveying devices each comprise a suction element having a first segment and at least one second segment, each of the suction elements being configured to receive, temporarily hold and release a respective one of the portions of the backlining material, and wherein each of the first segments comprise a first face configured to contact the backs of the book blocks and each of the at least one second segments comprises a second face configured to contact the backs of the book blocks, each of the at least one second segments being formed so as to be offsettable with respect to a respective one of the first segments in such a way that the contact face of the first segment touches the back of the book block whilst a contact face of the at least one second segment is at a distance from the back of the book block.

12. A device for applying portions of a backlining material to backs of book blocks, the device comprising:

a conveying apparatus configured to transport the book blocks through a book production line in a conveying direction;

a single pasting apparatus configured to apply an adhesive over an entire back length of the backs of the book blocks;

at least one backlining station comprising at least one supply apparatus configured to supply the backlining material and at least one cutting apparatus configured to cut the portions of the backlining material to length in accordance with a thickness of the back of a respective one of the book blocks to be supplied with the backlining material;

a first conveying device disposed after the single pasting apparatus in the conveying direction and configured to apply at least a first portion of the backlining material; and at least one second conveying device disposed after the first conveying device in the conveying direction and configured to apply at least a second portion to the backs of the book blocks such that, in each case, at least one of the portions overlaps another one of the portions, wherein the conveying devices each comprise a suction element having a first segment and at least one second segment, each of the suction elements being configured to receive, temporarily hold and release a respective one of the portions of the backlining material, and wherein, in each case, an actuator configured to offset the at least one second segment with respect to the first segment is arranged on the suction element.

13. A device for applying portions of a backlining material to backs of book blocks, the device comprising:

a conveying apparatus configured to transport the book blocks through a book production line in a conveying direction;

a single pasting apparatus configured to apply an adhesive over an entire back length of the backs of the book blocks;

at least one backlining station comprising at least one supply apparatus configured to supply the backlining material and at least one cutting apparatus configured to cut the portions of the backlining material to length in accordance with a thickness of the back of a respective one of the book blocks to be supplied with the backlining material;

a first conveying device disposed after the single pasting apparatus in the conveying direction and configured to apply at least a first portion of the backlining material; and at least one second conveying device disposed after the first conveying device in the conveying direction and configured to apply at least a second portion to the backs of the book blocks such that, in each case, at least one of the portions overlaps another one of the portions, wherein each of the conveying devices is assigned a first supply apparatus and a second supply apparatus for the backlining material, the second supply apparatus in each case being switchable by a machine control system in accordance with a respective size of a respective one of the book blocks to be provided with the portions of the backlining material.

* * * * *